US006068299A

United States Patent [19]

Peltzer

[11] Patent Number: 6,068,299

[45] Date of Patent: May 30, 2000

[54] BOOK HOLDER AND SUPPORT DEVICE

[76] Inventor: Eric T. Peltzer, 2857 Reposa La., Alta Dena, Calif. 91001

[21] Appl. No.: 09/244,008

[22] Filed: Feb. 4, 1999

[51] Int. Cl.[7] ..... B42D 3/00

[52] U.S. Cl. ..... 281/45; 281/28; 281/33; 281/42; 281/45

[58] Field of Search ..... 281/42, 45, 28, 281/33

[56] References Cited

U.S. PATENT DOCUMENTS

| | | | |
|---|---|---|---|
| 1,286,018 | 11/1918 | Jones . | |
| 1,692,337 | 4/1928 | Forbes . | |
| 2,156,225 | 4/1939 | O'Meara . | |
| 2,538,318 | 6/1951 | Mitchell . | |
| 2,638,300 | 5/1953 | De Jen . | |
| 2,741,869 | 4/1956 | Aibel . | |
| 3,140,558 | 7/1964 | Cassidy . | |
| 3,147,948 | 9/1964 | Evanoff . | |
| 3,198,475 | 8/1965 | Flahive | 248/455 |
| 3,514,066 | 5/1970 | Singleton et al. . | |
| 3,889,914 | 6/1975 | Torme . | |
| 3,894,709 | 7/1975 | Weir | 248/445 |
| 3,952,989 | 4/1976 | Bannister . | |
| 3,991,967 | 11/1976 | Sack . | |
| 5,016,852 | 5/1991 | Herendeen . | |
| 5,025,353 | 6/1991 | Menaged . | |
| 5,088,677 | 2/1992 | Chandler et al. . | |
| 5,205,526 | 4/1993 | Deutsch . | |
| 5,246,251 | 9/1993 | Evans . | |
| 5,305,114 | 4/1994 | Egashira et al. . | |
| 5,382,054 | 1/1995 | Bettiol | 281/42 |
| 5,393,029 | 2/1995 | Senko | 248/447 |
| 5,413,305 | 5/1995 | Leeb . | |
| 5,433,415 | 7/1995 | Samson et al. | 248/448 |
| 5,445,416 | 8/1995 | Zareck | 281/42 |

FOREIGN PATENT DOCUMENTS 329011 11/1920 Germany .

OTHER PUBLICATIONS

Advertisements, Levanger: Tools for Serious Readers, 1995, p.28, 32, 72.

Advertisement, Reader's Window: The overhead bood holder.

*Primary Examiner*—Willmon Fridie, Jr.
*Assistant Examiner*—Daniel Phan
*Attorney, Agent, or Firm*—Trojan Law Offices

[57] ABSTRACT

A device for holding and supporting a book or similar object comprising; a plate having a surface and a plane substantially aligned with said surface, means, attached to the plate, for holding a book in an opened position and securing the book to said plate, and means, attached to the plate, for positioning the plate at an angle relative to a surface which the device is positioned upon, such that a book or similar object may be held in an angled and opened position in a stable manner to aid in reading or referencing the book or similar object by a user.

10 Claims, 2 Drawing Sheets

BOOK HOLDER AND SUPPORT DEVICE

BACKGROUND OF THE INVENTION

1. Field of the Invention

This invention relates to book supports or reading stands.

2. Background Art

Since the very advent of the book, the reader has had a tedious task of keeping the book open while reading. Books typically must be constantly held open with one or two hands. Often this involves pressing the book down against a table or cradling it in one's lap, but it almost always involves the continuous use of the reader's hands and fingers. This typically causes stress, fatigue, discomfort or even pain to the reader's hand and fingers.

Also, since most books, especially paperbacks, will close by themselves once opened, it is very difficult to keep one's place in the book. Absent a bookmark, many readers will bend a page over or attempt to lay the book open with the particular pages face down. These methods often fail to maintain the desired page before the reader can resume where he or she left off. Bent pages not only damage the book, but they can easily become unbent or over several occasions of bending, more than one page can be left bend. Leaving the book open face down to the desired page also presents problems as the book is often accidentally closed by misplacing or moving it.

Further, in many activities it is desirable to have the book not only held open, but also kept in a substantially upright position. Keeping the book in such a position allows the user to read the book hands free and at some distance from the book. One example of an activity that benefits from keeping a book open and substantially upright is cooking. When one is cooking, often reference has to be made to the recipe. Obviously it is much easier on the cook to be able to keep the cookbook visible and open to a specific page while having the cook's hands free. Not only would this facilitate the cooking process, it would have an added benefit of keeping the cookbook clean as it would not have to be touched repeatedly by the cook's hands.

Many devices have in the past have attempted to solve these problems. Some have operated by simply holding or otherwise positioning the book in an upright position. Others have included the ability to secure the pages in place and/or tilt the book up from the horizontal plane. These devices have attempted to solve the aforementioned problems with mixed results. Although some of the prior designs do hold books open and at an angle, they have problems and drawbacks to their designs. For example, some prior devices are awkward, large and cumbersome, this prevents them from being easily portable. Portability is a feature strongly desired in a bookholder since most books are likewise portable. Even those which are portable are unfortunately rather bulky and not easy to carry with the reader.

Another limitation of many of the prior bookholders is that they will hold the book in only a single position. Clearly, being able to alter the position of the book as necessary to accommodate the reader is an desired feature. Some of the prior designs do not adequately secure the pages of the book and/or obscure a portion of the book's printed matter. This makes those particular bookholders difficult to use and cause the user significant frustration. Some of the prior devices also are not versatile enough to accommodate a variety of sizes and shapes of different books. Lastly, many of the prior devices are so complicated in their design and structure which results in a high cost of manufacture.

No single prior invention has combined the qualities of the invention described herein. The bookholder set forth herein is much smaller, lighter, and simpler than the prior devices. By having a simple and compact design which can be easily transported and which efficiently holds a book in variety of positions, the invention described herein meets the needs of readers while being capable of being manufactured at a reasonable cost.

SUMMARY OF THE INVENTION

This invention provides a device for holding and positioning a book or other illustrative materials. This invention meets its objectives by being compact, small in size, simple in design and manufacture. It is also designed to be capable of securely holding a variety of sizes and shapes of books in several positions. Further, this invention is sized, shaped and operates in such a manner such that the reader can quickly secure it to a book and position the book as desired to ease the process of reading or referencing the book.

An object of this invention is to secure or hold a book or other illustrative materials in place. For bound multi-page materials, such as books, it is an object of the invention to hold them open at a desired page. The goal is to have the invention hold the item in such a manner that the reader does not have to actively and constantly hold it open. With the invention holding the book at a desired page, the reader can have his or her hands free. It is important that the invention be capable of holding the book securely enough that the book with the invention attached, can be adjusted, repositioned or moved without the invention releasing the book or any of its pages.

Another object of the invention is to provide a means for holding the pages in place while still allowing the reader to quickly and easily turn or change pages. Considering that in a single session of reading a user may turn a great number of pages, the invention allows the reader to quickly and easily release, turn, and resecure the pages as he or she reads.

Another object of the invention is to allow a book or other illustrative materials to be held in several different positions relative to the surface the invention and book rest upon. Giving the reader several different positions to chose from provides more versatility to the reader. In so doing, the invention will provide the reader with the ability to set the book with holder attached upon a flat surface and position the opened book substantially upright such that the book's text, illustrations or other printed materials will be from a position in front of and above the book. Such a position will increase the stability of the holder with book attached and allowed for ease of reading or reference.

Another object is to provide a device which is small, compact, lightweight and portable. This object is important because a majority of books are portable. Therefore, to be able to carry the device along with the book allows the invention to be used very frequently in a variety of locations.

Another object of this invention is to provide a device which is simple and inexpensive to manufacture. Obtaining this goal will allow the device to be sold to the public at a low final cost per unit.

These and other more specific objects will appear upon reading the following specification and claims and upon considering in connection therewith the attached drawings to which they relate.

As noted in the aforementioned objects, the invention seeks to provide a bookholder which will securely hold a book or similar item with the pages open to a desired place and allow the book to be placed at several positions relative to the surface it is resting upon. This bookholder device is typically configured with a plate which will rest against the back of the book, two page clips attached to the plate which are shaped and sprung such that they will hold the pages in place, and two support legs which are also attach to the plate, which can be positioned to set the book in one of several positions. The support legs can be turned to lay flat with the plate such that the book can lay flat, or the legs can be turned out away from the plate such that the book can be positioned at an angle. Further, the invention can be attached to either end of the book in order to provide different angles and positions of support.

This ability of the invention to secure pages in place while allowing the book to be placed in a variety of positions, along with its simple, compact and lightweight design will allow the user to read the book without incurring the problems inherent with prior bookholder designs or with simply holding the book him or herself.

BRIEF DESCRIPTION OF THE DRAWINGS

The advantages of the invention can be more clearly understood by reference to the drawings in which.

DETAILED DESCRIPTION OF THE PREFERRED EMBODIMENT

Figure 1:
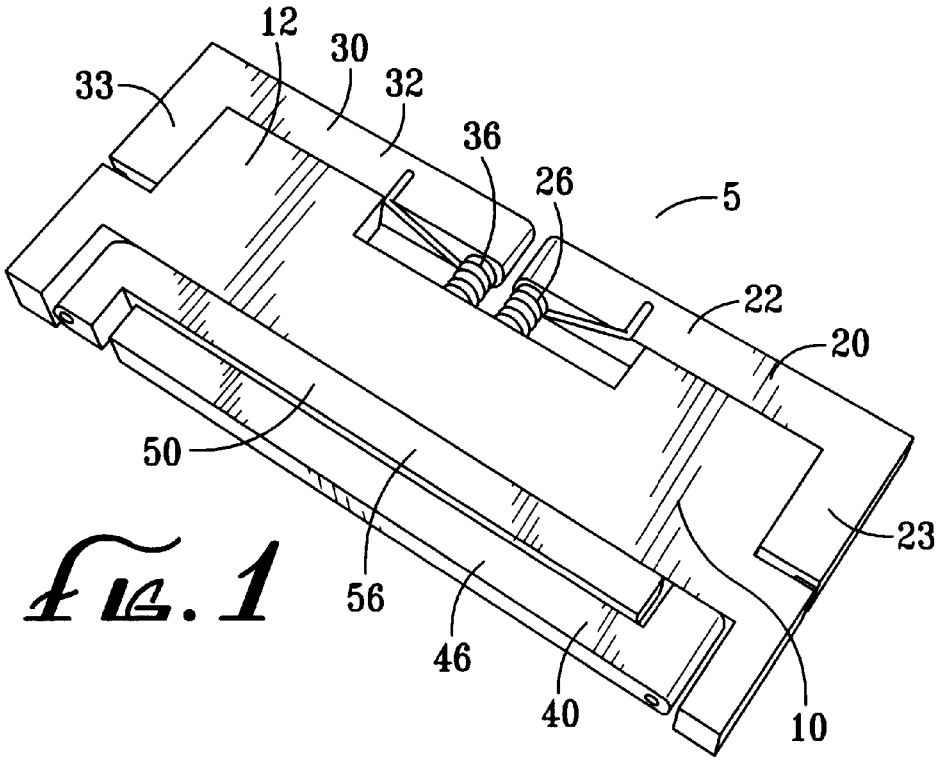
FIG. 1 is a perspective view showing the front side of the device.

The primary elements of this invention include a plate (10), means for holding a book or similar object and securing the book or similar object to said plate, and means for positioning the book or similar object at an angle relative to a surface which the device is positioned upon.

The plate has a front face (12), back side (13), top end (14), bottom end (15), first recess (16), first rest plate (17), second recess (18) and second rest plate (19).

Another primary element of device (5) is means for holding a book or similar object and securing the book or similar object to said plate. This means for can be accomplished by many possible embodiments. For example, the means for holding and securing can comprise first clip (20) and second clip (30) which cooperate to secure an opened book in place. First clip (20) is pivotally mounted to top end (14) of plate (10) and comprises first projecting arm (22), first contact arm (23), first contact surface (24), first clip pin (25), first spring (26), first clip side-tab (28) and first clip top-tab (29). Likewise, second clip (30) is pivotally mounted to top end (14) of plate (10) and comprises second projecting arm (32), second contact arm (33), second contact surface (34), second clip pin (35), second spring (36), second clip side-tab (38) and second clip top-tab (39). First clip (20) and second clip (30) can be raised to place books of varying shapes, sizes and thicknesses under and then released to secure and hold the book.

Another primary element of device (5) is means for positioning a book or similar object at an angle relative to a surface which device (5) is positioned upon. This means can be accomplished by many possible embodiments. For example, the means for positioning can comprise first support leg (40) and second support leg (50), where first support leg (40) and second support leg (50) are both pivotally mounted to bottom end (15) of plate (10). First support leg (40) and second support leg (50) can be rotated outward from plate (10) so has to provide support to allow plate (10) to be positioned at an angle relative to the surface which plate (10) rests. First support leg (40) and second support leg (50) can also be rotated to a position to that they are substantially aligned with plate (10) to allow plate (10) to lie flat and to make device (5) more compact and therefore easier to transport. First support leg (40) comprises first pin (42), first curved surface (44) and first leg (46). Second support leg (50) comprises second pin (52), second curved surface (54) and second leg (56).

It should be noted that the preferred embodiment of this invention includes elements which perform the function of the means elements described above. In the preferred embodiment the primary elements of the invention are further defined as follows.

In the preferred embodiment plate (10), comprises front face (12), back side (13), top end (14), bottom end (15), first recess (16), first rest plate (17), second recess (18) and second rest plate (19). Front face (12) is sized and shaped to receive a cover of an opened book. Specifically, it is preferred that front face (12) be substantially planar, such that said front face (12) may receive both a front cover and a back cover of an opened book and in so doing, keep the front cover and the back cover in substantially the same plane when the book is retained by device (5). Being substantially planar, allows front face (12) to be used to display graphics, instructions, the title of the product or the like. Front face (12) has first recess (16) and second recess (18). Both first recess (16) and second recess (18) are sized and positioned to respectively receive first clip (20) and second clip (30) such that when no book is retained by device (5) first clip (20) and second clip (30) will lay substantially flush with front face (12). With the clips positioned substantially flush with front face (12) device (5) is compact and easier to transport. When first clip (20) is fully received by first recess (16) first clip (20) rests upon first rest plate (17). First rest plate (17) prevents first clip (20) from pivoting further then necessary to have first clip (20) substantially flush with front face (12). Similarly, second recess (18) receives second clip (30) and prevents first clip (20) from pivoting further than necessary to be substantially flush with front face (12). Although first rest plate (17) and second rest plate (19) can be of a variety of shapes and sizes it is preferred that they both project an equal length upwards toward top end (14). This is preferred because when a book is held at this bottom and the support legs are use to angle the book and plate (10), plate (10) will rest upon the ends of first rest plate (17) and second rest place (19). If these two rest plates are not even in length, then plate (10) will also not be even. Further, it is preferred that both first rest plate (17) and second rest plate (19) have sufficient length to allow the clip to be fully received by the recesses when no book is retained by device (5) and device (5) is positioned at angle resting on the rest plates and the extended support legs.

In the preferred embodiment, back side (13) is substantially planar to aide in the portability of device (5). It is preferred that plate (10) be configured such that first clip (20) and second clip (30) be pivotally mounted to the top end (14) of plate (10). Likewise, it is preferred that first support leg (40) and second support leg (50) be pivotally mounted to the bottom end (15) of plate (10).

In the preferred embodiment first clip (20) comprises projecting arm (22), first contact arm (23), first clip pin (25), first clip spring (26), first clip side-tab (28) and first clip top-tab (29). First clip (20) is pivotally mounted to the top end (14) of plate (10). First clip (20) is sized and shaped to receive and hold a portion of a book in an opened position when device (5) retains a book. First clip (10) is constructed to retain a portion of opened books of various thicknesses, sizes and shapes. This retention is achieved by resiliently urging first clip (20) against the pages of the opened book and in so doing exert sufficient force to hold the book in position. The first projecting arm (22) is pivotally mounted at one end to the top end (14) of plate (10). First contact arm (23) is located at the opposite end of first projecting arm (22). First contact arm (23) is angled down from first projecting arm (22) so as to be capable of being placed over a portion of the open book to be held. On the underside of first contact arm (23) is first contact surface (24), which directly contacts the portion of the book to be held by first clip (20). Although first contact surface (24) can have many different textures, it is preferred that first contact surface (24) is generally smooth to aid in sliding pages out from under first clip (20) when a page needs to be turned. First pin (25) connects first clip (20) to plate (10). In so doing, first pin (25) allows first clip (20) to be pivoted mounted to plate (10). First spring (26) is mounted between first clip (20) and plate (10). First spring (26) operates to resiliently urge first clip (20) against plate (10) when no book is retained by device (5). When a book is retained by device (5) and first clip (20) is placed over a portion of the book, first spring (26) urges first clip (20) unto the portion of the book to cause the book to be held in place. It is preferred that first spring (26) is a coil mounted between first projecting arm (22) and plate (10) and about first pin (25). First clip side-tab (28) is positioned at the outer edge of first clip (20). First clip side-tab (28) is shaped and positioned to receive the reader's finger to facilitate the raising or lowering of first clip (20) whether the clip is positioned in the first recess (16) or on a page of a book. First clip top-tab (29) runs along the top edge of first projecting arm (22). First clip top-tab (29) functions similar to first clip side-tab (28) as it is positioned and sized to allow the reader to easily raise or lower the clips.

In the preferred embodiment second clip (30) comprises projecting arm (32), second contact arm (33), second clip pin (35), second clip spring (36), second clip side-tab (38) and second clip top-tab (39). Second clip (30) is pivotally mounted to the top end (14) of plate (10). second clip (30) is sized and shaped to receive and hold a portion of a book in an opened position when device (5) retains a book. Second clip (10) is constructed to retain a portion of opened books of various thicknesses, sizes and shapes. This retention is achieved by resiliently urging second clip (30) against the pages of the opened book and in so doing exert sufficient force to hold the book in position. The second projecting arm (32) is pivotally mounted at one end to the top end (14) of plate (10). second contact arm (33) is located at the opposite end of second projecting arm (32). Second contact arm (33) is angled down from second projecting arm (32) so as to be capable of being placed over a portion of the open book to be held. On the underside of second contact arm (33) is second contact surface (34), which directly contacts the portion of the book to be held by second clip (30). Although second contact surface (34) can have many different textures, it is preferred that contact surface (34) is generally smooth to aid in sliding pages out from under second clip (30) when a page needs to be turned. Second pin (35) connects second clip (30) to plate (10). In so doing, second pin (35) allows second clip (30) to be pivoted mounted to plate (10). Second spring (36) is mounted between second clip (30) and plate (10). Second spring (36) operates to resiliently urge second clip (30) against plate (10) when no book is retained by device (5). When a book is retained by device (5) and second clip (30) is placed over a portion of the book, second spring (36) urges second clip (30) unto the portion of the book to cause the book to be held in place. It is preferred thar second spring (36) is a coil mounted between second projecting arm (32) and plate (10) and about second pin (35). Second clip side-tab (38) is positioned at the outer edge of second clip (30). Second clip side-tab (38) is shaped and positioned to receive the reader's finger to facilitate the raising or lowering of second clip (30) whether the clip is positioned in the second recess (16) or on a page of a book. Second clip top-tab (39) runs along the top edge of second projecting arm (32). Second clip top-tab (39) functions similar to second clip side-tab (38) as it is positioned and sized to allow the reader to easily raise or lower the clips.

It is preferred that first clip (20) be positioned opposite to second clip (30) such that said first clip (20) and second clip (30) are positioned to cooperate with each other in retaining an opened book.

In the preferred embodiment first support leg (40) comprises first pin (42), first curved surface (44) and first leg (46). First support leg (40) is pivotally mounted to the bottom end (15) of plate (10). With support leg (40) so mounted it is capable of being rotated outward to the rear of plate (10) to provide support and allow plate (10) to be positioned at an angle to the surface it is resting upon. First pin (42) connects first support leg (40) to plate (10) and allows plate first support leg to rotate about plate (10). First curved surface (44) is shaped to prevent first support leg (40) from contacting plate (10) when first support leg (40) is rotated. It is preferred that first leg (46) be of sufficient length to provide the sufficient stability to device (5).

In the preferred embodiment second support leg (50) comprises second pin (52), second curved surface (54) and second leg (56). Second support leg (50) is pivotally mounted to the bottom end (15) of plate (10). With support leg (50) so mounted it is capable of being rotated outward to the rear of plate (10) to provide support and allow plate (10) to be positioned at an angle to the surface it is resting upon. Second pin (52) connects second support leg (50) to plate (10) and allows plate second support leg to rotate about plate (10). Second curved surface (54) is shaped to prevent second support leg (50) from contacting plate (10) when second support leg (50) is rotated. It is preferred that second leg (56) be of sufficient length to provide the sufficient stability to device (5).

It is preferred that the thickness of both first support leg (40) and second support leg (50) are substantially the same as the thickness of plate (10) such that when the support legs are positioned to be aligned with plate (10) the support legs are substantially flush with both front face (12) and back side (13) of plate (10). This allows the device (5) to be more compact and makes the device (5) easier to transport.

It is also preferred that first support leg (40) and second support leg (50) are mounted on bottom end (15) opposite of each other and outward from the center of plate (10). Mounted in this manner the support legs can be positioned to provide a wide base when extended, which increases the stability of the device (5). Also, it is preferred that the support legs be 'L-shaped' so that they can be alternately mounted such that one leg is retained close to bottom end

(15) when the leg is positioned aligned with plate (10) and so the other leg can be spaced a distance away from bottom end (15) so as to lie next to, but not contact the closer leg when positioned aligned with plate (10). With the support legs so configured, the support legs, when kept aligned with plate (10), can make the device (5) more compact and easier to transport.

The preferred embodiment is just one of many possible embodiments of the invention covered by the claims of this application. Many additions or modifications of the elements of this device may be made. For example, many of the elements could be made of various lengths to accommodate needs of the users. Also, the positions of various elements could be moved about relative to each other.

The preferred embodiment of this invention is shown in the included drawings.

FIG. 1 is a perspective view showing the front side of the device. In this view all the major elements of the invention can be seen. Attached to plate (10) at top end (14) is first clip (20) and second clip (30). Holding first clip (20) and second clip (30) in place are first spring (26) and second spring (36) respectively. First spring (26) is mounted between plate (10) and first clip (20) and provides a resilience force which urges first clip (20) to be held against plate (10). Likewise, second spring (36) is mounted between plate (10) and second clip (30) and provides a resilience force which urges second clip (30) to be held against plate (10). As can be seen first clip (20) is received in first recess (16) such that it is substantially flush with front face (12). Similarly, second clip (30) is received in second recess (18) such that it is also substantially flush with front face (12). Mounted to bottom end (15) of plate (10) is first support leg (40) and second support leg (50). First support leg (40) and second support leg (50) are pivotally mounted to the bottom end (15) so that they may be turned outward to provide support for device (5). As shown in this figure, first support leg (40) and second support leg (50) are positioned so as to be aligned with front face (12) of plate (10). With first clip (20), second clip (30), first support leg (40) and second support leg (50) positioned as shown in this figure device (5) is compact and easy to carry.

Figure 2:
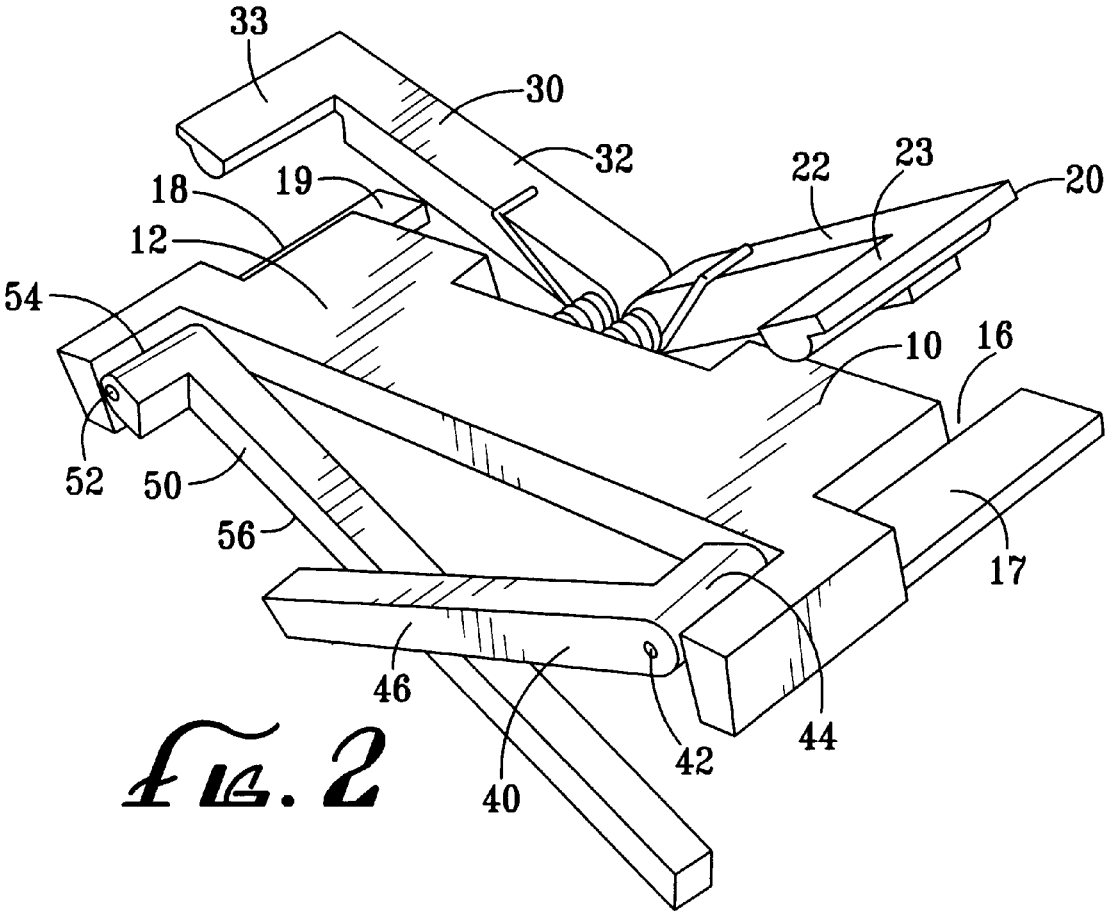
FIG. 2 is a perspective view of the device the front side of the device with the two page clips and the two support legs partially extended from the plate.

FIG. 2 is a perspective view of the device (5) showing the front face (12) of the device with the clips and support legs partially extended from plate (10). As can be seen in this figure, both first clip (20) and second clip (30) have been displaced upward. In this position an opened book can be placed under each first clip (20) and second clip (30) such that the opened book will be held open and secured to plate (10). With both first clip (20) and second clip (30) so extended, first recess (16) and second recess (18) are clearly visible. Also, first rest plate (17) and a portion of second rest plate (19) can been seen in each of the respective recesses. First rest plate (17) receives and acts as a stop for first clip (20) when first clip (20) is in its closed position substantially flush with front face (12). Likewise, second rest plate (19) receives and acts as a stop for second clip (30) when second clip (30) is in its closed position substantially flush with front face (12). This figure also shows first clip side-tab (28) and second clip side-tab (38) which are positioned at the outer edges of first clip (20) and second clip (30) respectively. First clip side-tab (28) and second clip side-tab (38) are both shaped and positioned to receive the reader's finger to facilitate the raising or lowering of the clips whether the clips are positioned in the recesses or on a page of a book. As can also be seen in this figure first support leg (40) and second support leg (50) have been pivoted outward from a position of being aligned with front face (12) of plate (10). Although first support leg (40) and second support leg (50) would provide support for device (5), typically, one or both of the support legs would be turned father outward. As can be seen first support leg (40) has been pivoted about pin (42) and second leg (50) has been pivoted about pin (52). Finally, in this figure curved surface (44) of first support leg (40) and curved surface (54) of second support leg (50) can be seen. These curved surfaces allow the support leg to be rotated by providing sufficient clearance between the support legs and plate (10).

Figure 3:
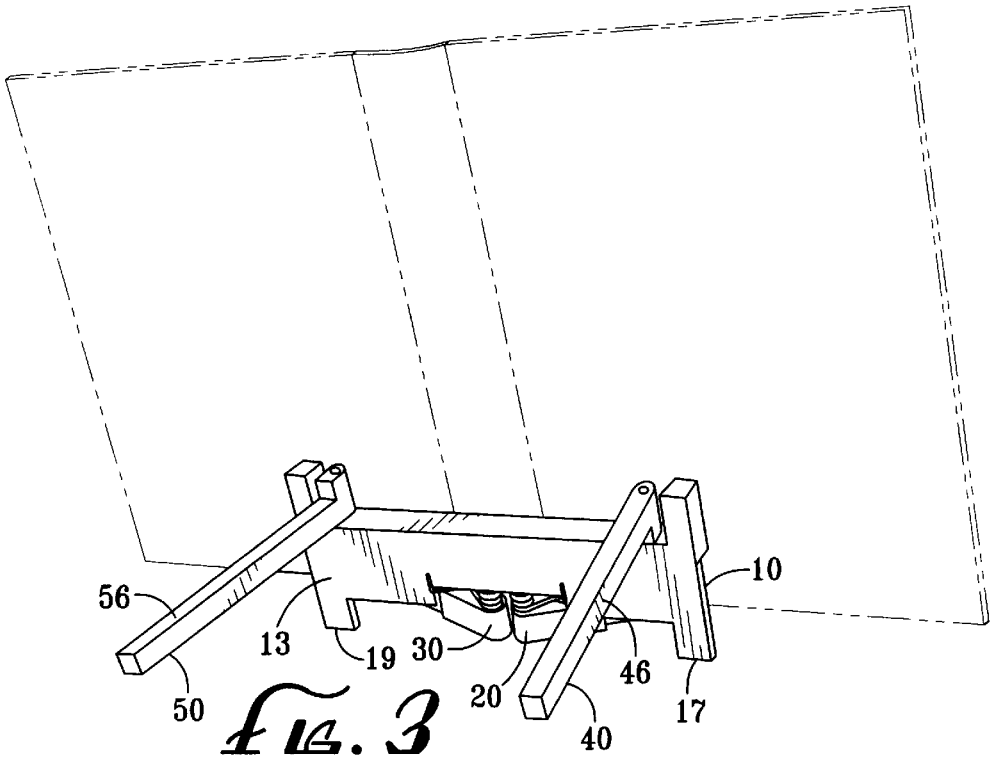
FIG. 3 is a perspective view showing the back side of the device with the support legs extended and a book being held at its bottom by the page clips.

FIG. 3 is a perspective view showing the back side (13) of plate (10) with first clip (20), second clip (30), first support leg (40) and second leg (50) extended. Further this figure shows a book being held at its bottom by both first clip (20) and second clip (30). As can be seen, first support leg (40) and second support leg (50) are positioned outward from plate (10). In this position first support leg (40) and second support leg (50) provide support for plate (10) and the book attach thereto and angle plate (10) relative to the surface it rests upon.

Figure 4:
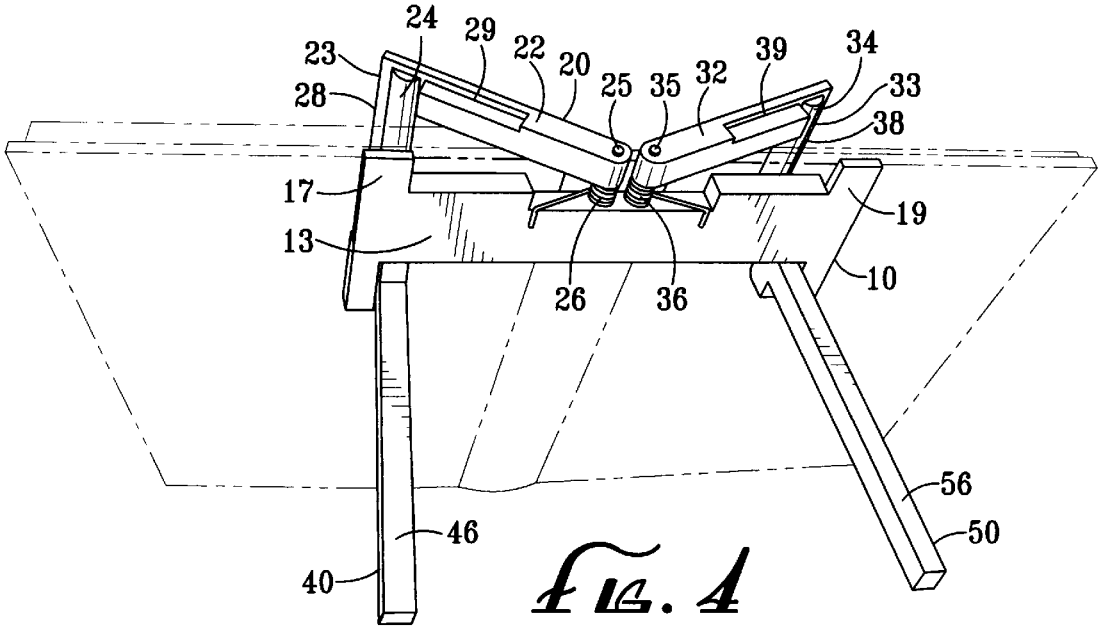
FIG. 4 is a perspective view showing the back side of the device with the support legs extended and a book being held at its top by the page clips.

FIG. 4 is a perspective view showing the back side (13) of plate (10) with the support legs extended and a book being held at its top by the clips. The positioning of device (5) at the top of the book as shown in this figure is an alternative to the positioning associated with attaching device (5) to the bottom of the book as shown in FIG. 3. As can be seen, first support leg (40) and second support leg (50) are positioned outward from plate (10). In this position first support leg (40) and second support leg (50) provide support for plate (10) and the book attach thereto and angle plate (10) and the book relative to the surface they rest upon. This provides for an angle which, depending on the particular size of the book and the length and angle of the support legs, can differ from the angle device (5) is attached to the bottom of the book as shown in FIG. 3. In this figure, first clip (20) and second clip (30) are shown holding and securing a book. Specifically, first contact surface (24) and second contact surface (34) are shown engaging pages of the open book. From the angle shown in this figure not only can first clip side-tab (28) and second clip side-tab (38) be seen, first clip top-tab (29) and second clip top-tab (39) can also be seen. As shown, first clip top-tab (29) and second clip top-tab (39) run along the top edge of the first projecting arm (22) and second projecting arm (32) respectively. first clip top-tab (29) and second clip top-tab (39) function similar to the side clip tabs as they positioned and sized to allow the reader to easily raise or lower the clips.

What is claimed is:

1. A portable device for holding a book in an open position, the book having a spine, the portable device comprising:

a plate having a first edge, a second edge, a top end, a bottom end, a front face and a back side, the top end being opposite the bottom end, the top end having a midpoint;

two clips, each clip having a first end being mounted at a pivot point located substantially at the midpoint of the top end of the plate, the pivot point of each clip being substantially aligned with the spine of the book, the clips having an operational position and a nonoperational position, the clips being substantially flush with the front face of the plate when the clips are in the nonoperational position, each pivot point including a spring for urging the clips against the book in the operational position and substantially flush with the front face of the plate in the nonoperational position;

a first support leg having a functional position and a nonfunctional position, the first support leg is pivotally mounted to the bottom end of the plate at the first edge, the first support leg being substantially flush with the front face and the back side of the plate when the first support leg is in the nonfunctional position; and a second support leg having a functional position and a nonfunctional position, the second support leg is pivotally mounted to the bottom end of the plate at the second edge, the second support leg being substantially flush with both the front face and the back side of the plate when the first support leg is in the nonfunctional position;

wherein the first support leg and the second support leg support the book on a surface in a position where the front face of the plate is at an angle to the surface upon which the device is located;

wherein the positioning of all the elements allows for the portability of the device.

2. The portable device of claim 1, wherein the two clips are L-shaped, each clip is comprised of a projecting arm and a contact arm, the projecting arm has a top edge and the contact arm has an outer edge.

3. The portable device of claim 1, wherein the plate further comprises a first rest plate for holding the first clip in the nonoperational position and a second rest plate for holding the second clip in the nonoperational position.

4. The portable device of claim 2, wherein each of the two clips further comprise a side-tab, located on the outer edge of each of the clips, for aiding a user in moving each clip from the nonoperational position to the operational position and for allowing the user to lift the clip from the book to turn a page.

5. The portable device of claim 2, wherein each of the two clips further comprise a top-tab, located on the top edge of each of the clips, for aiding a user in moving each clip from the nonoperational position to the operational position and for allowing the user to lift the clip from the book to turn a page.

6. A portable device for holding a book in an open position, the book having a spine, the portable device comprising:

a plate having a first edge, a second edge, a top end, a bottom end, a front face and a back side, the top end being opposite the bottom end, the top end having a midpoint;

two clips, each clip having a first end being mounted at a pivot point located substantially at the midpoint of the top end of the plate, the pivot point of each clip being substantially aligned with the spine of the book, the clips having an operational position and a nonoperational position, the clips being substantially flush with the front face of the plate when the clips are in the nonoperational position, each pivot point including a spring for urging the clips against the book in the operational position and substantially flush with the front face of the plate in the nonoperational position;

a first support leg having a functional position and a nonfunctional position, the first support leg is pivotally mounted to the bottom end of the plate at the first edge, the first support leg being substantially flush with the back side of the plate when the first support leg is in the nonfunctional position; and a second support leg having a functional position and a nonfunctional position, the second support leg is pivotally mounted to the bottom end of the plate at the second edge, the second support leg being substantially flush with the back side of the plate when the first support leg is in the nonfunctional position;

wherein the first support leg and the second support leg support the book on a surface in a position where the front face of the plate is at an angle to the surface upon which the device is located;

wherein the positioning of all the elements allows for the portability of the device.

7. The portable device of claim 6, wherein the two clips are L-shaped, each clip is comprised of a projecting arm and a contact arm, the projecting arm has a top edge and the contact arm has an outer edge.

8. The portable device of claim 6, wherein the plate further comprises a first rest plate for holding the first clip in the nonoperational position and a second rest plate for holding the second clip in the nonoperational position.

9. The portable device of claim 7, wherein each of the two clips further comprise a side-tab, located on the outer edge of each of the clips, for aiding a user in moving each clip from the nonoperational position to the operational position and for allowing the user to lift the clip from the book to turn a page.

10. The portable device of claim 7, wherein each of the two clips further comprise a top-tab, located on the top edge of each of the clips, for aiding a user in moving each clip from the nonoperational position to the operational position and for allowing the user to lift the clip from the book to turn a page.

* * * * *